United States Patent [19]

Tieszen

[11] 4,376,966

[45] Mar. 15, 1983

[54] STRIP LIGHTS AND METHOD OF MAKING SAME

[75] Inventor: Dwayne A. Tieszen, Wichita, Kans.

[73] Assignee: Vista Manufacturing, Inc., Elkhart, Ind.

[21] Appl. No.: 138,203

[22] Filed: Apr. 7, 1980

[51] Int. Cl.[3] ..... F21V 15/00; F21V 31/02

[52] U.S. Cl. ..... 362/249; 362/223; 362/267; 362/293; 362/294; 362/311; 362/318; 362/320; 156/294; 228/179

[58] Field of Search ..... 362/227, 249, 217, 33, 362/223, 209, 236, 252, 278, 306, 311, 320, 267, 293, 294, 318; 156/294; 228/179

[56] References Cited

U.S. PATENT DOCUMENTS 4,107,767 8/1978 Anquetin ..... 362/252

4,177,503 12/1979 Anquetin ..... 362/252

4,271,458 6/1981 George ..... 362/252

*Primary Examiner*—Irwin Gluck

*Attorney, Agent, or Firm*—Robert E. Breidenthal

[57] ABSTRACT

A series of electric lamps spaced along the interior of a flexible vinyl tube, such lamps being connected in electric parallel with each other by a pair of insulated conductors that exit from the tube through an opening adjacent one end of the tube. A thermoplastic sealant having a vinyl content is applied by a special procedure into each of the ends of the tube to seal closed such ends of the tube as well as the point of egress of the conductors. The tube is disposed in a channel-like mounting bracket having a restricted entrance through which the tube is viewable. A special procedure is provided for connecting uninsulated leads of the lamps to insulated parallel conductors such that no additional insulation is required.

14 Claims, 10 Drawing Figures

FIG. 1
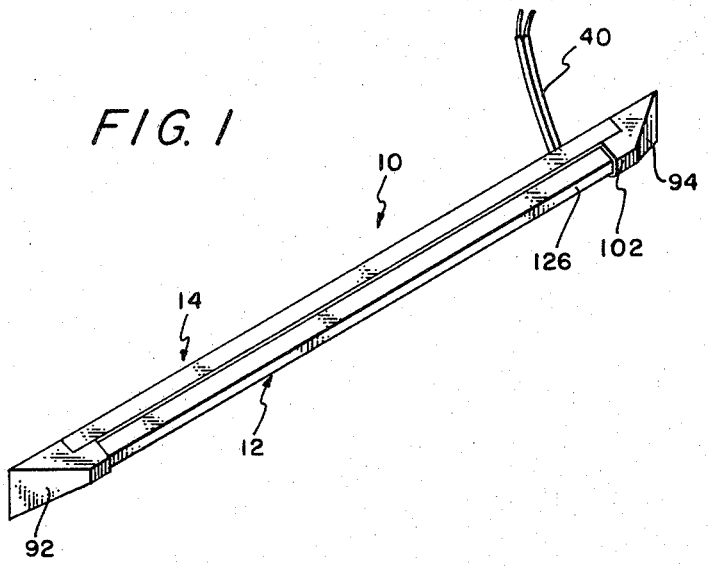
FIG. 2
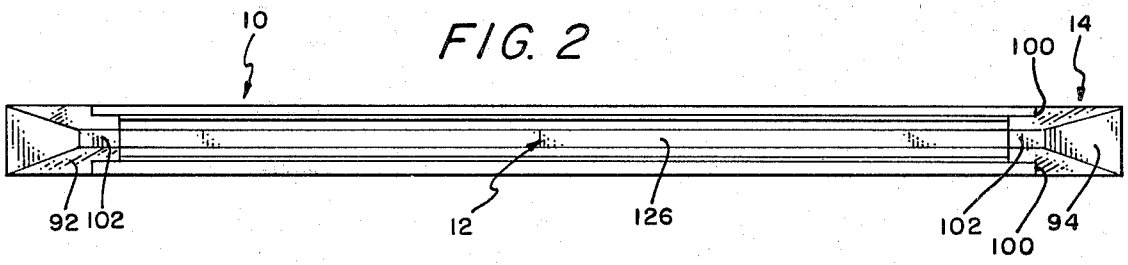
FIG. 3
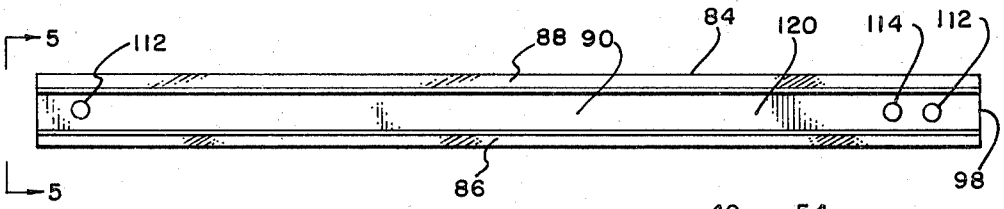
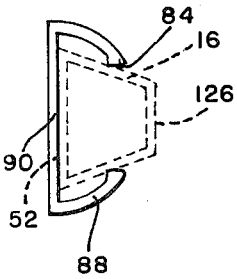
FIG. 5
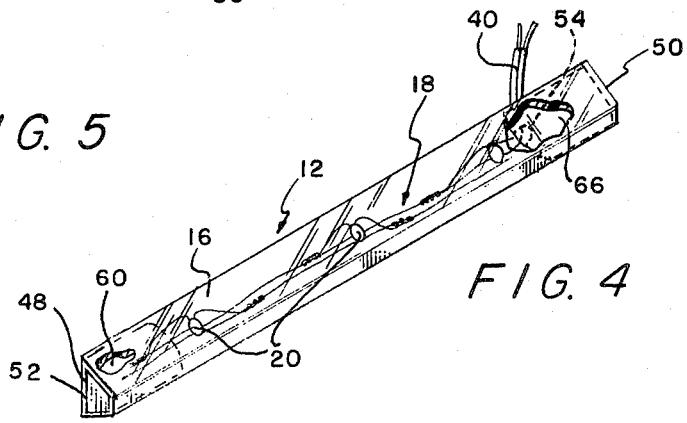
FIG. 4

FIG. 6
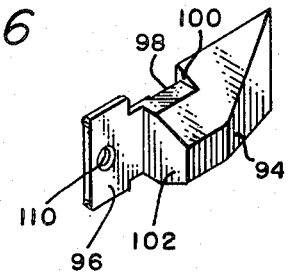
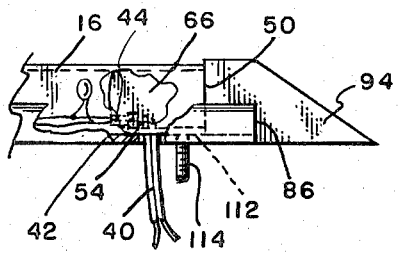
FIG. 7
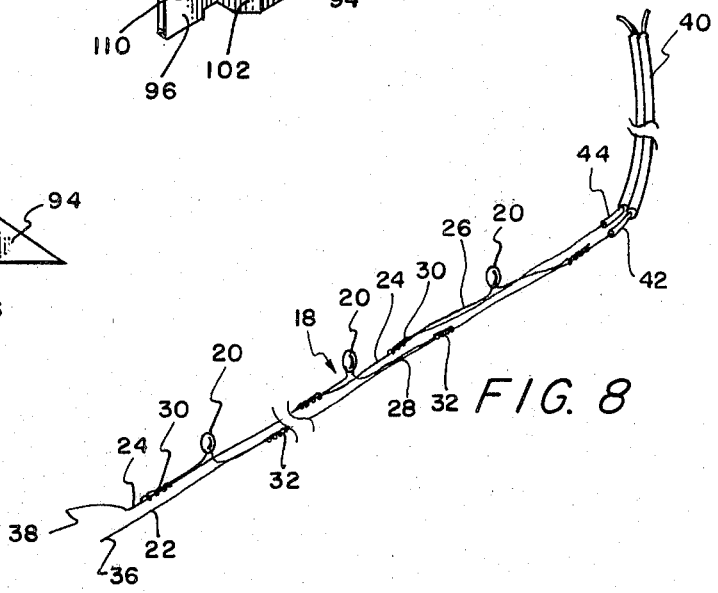
FIG. 8
FIG. 9
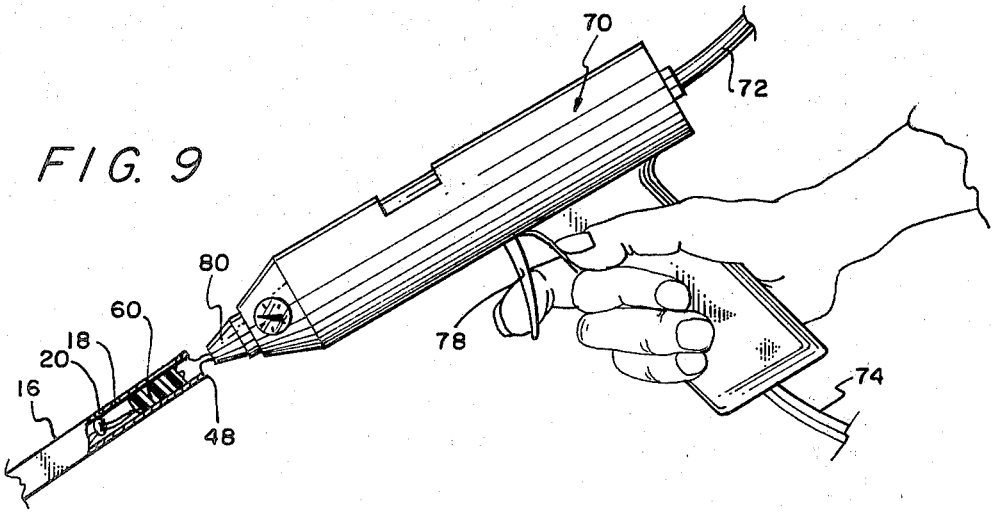
FIG. 10
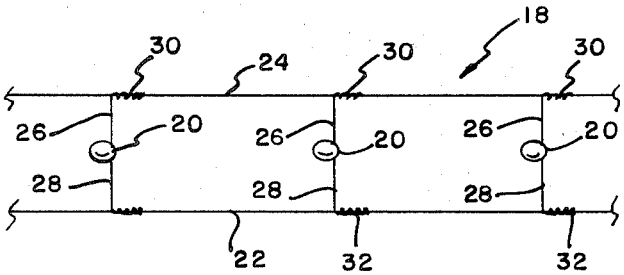

STRIP LIGHTS AND METHOD OF MAKING SAME

The present invention relates to new and useful improvements in the making and mounting of electric lamps, and more particularly, pertains to such improvements relative to strip lights of the type including a set of electric lamps that are spaced from and immovable with respect to each other and which are associated with a common mounting means and which are also associated with a single pair of electric leads for energization.

It has long been a common practice to provide sets of electric lamps fixed in position relative to each other and which are energizable from a single pair of electric leads. Numerous examples come immediately to mind such as Christmas ornamentation of the type that includes a base carrying a plurality of upstanding tubes each topped with an electric lamp to simulate a series of candles in overall appearance.

Prior art proposals appear to be subject to various shortcomings. Among such shortcomings may be mentioned that they tend to be large and of such nature as not to be readily susceptible to miniaturization so as to conserve energy consumption or satisfy a need for small display; they are either not suited for mounting in locations exposed to weather or require elaborate weatherproofing provisions such as special sockets equipped with flexible seals for sealing engagement with the envelopes of lamps screwed thereinto; electrical conductors connecting between lamps being either exposed to damage by abrasion or to the ingress of water; exposure of lamps to physical damage; high cost; and difficulty of installation.

Accordingly, the paramount object of the instant invention is to provide durable strip lights at a reasonable price, with such strip lights being easily installed.

Another important object of the invention in accordance with the above object is to provide a strip light wherein the lamps as well as conduits connecting the lamps are protected against physical damage as well as against damage by the weather and the ingress of water.

Another important object is to provide a method of electrically connecting uninsulated leads of lamps to a pair of insulated conductors such that the lamps are in electrical parallel and can be installed without any need for insulation of the leads following their having been connected.

Yet another important object is to provide a strip light wherein the lamps are placed in a flexible plastic tube of such selected light transmissivity characteristic or color filtering property to imbue the lamps with the appearance of selected colors.

A broad aspect of the invention involves a method of connecting a plurality of lamps, each having a pair of electric leads in electrical parallel between a pair of elongated insulated conductors comprising the steps of electrically and mechanically connecting remote end portions of the leads of each lamp respectively to one and the other of said conductors while the latter are spaced apart, and thereafter placing the insulated conductors in closely spaced side by side relationship while shifting one of the insulated conductors in an endwise direction relative to the other by an amount sufficient that the leads of each lamp are oppositely extending and in closely spaced side by side relationship with the insulated conductors, whereby the electrical and mechanical connection to an insulated conductor may be effected with the use of heat while minimizing by spacing any possibly deleterious effect of heat upon the other insulated conductor.

Another broad aspect of the invention involves, for use in a strip light, a pair of insulated electrical conductors in closely spaced side by side relationship, a plurality of electric lamps spaced along said pair of conductors, each of said lamps having a pair of oppositely extending electric leads disposed in side by side relationship with said pair of insulated conductors and having first and second remote extremities respectively connected electrically and mechanically to one and the other of said pair of insulated conductors, said lamps having a spacing along the pair of insulated conductors sufficiently great that the electric leads of each lamp are spaced along such electric conductors from the electric leads of the lamps adjacent thereto, the arrangement being such that the lamps are connected in electrical parallel between the conductors and such that the electric leads need not be electrically insulated to avoid any electrical shorting path between the conductors.

Still another aspect of the invention involves, in light strip construction, an elongated tubular member having first and second ends, and being provided with a pair of insulated and flexible electric conductors extending from a position within the interior of the tubular member to the exterior thereof, a first sealing means transversely filling the tubular member at a location adjacent the first end thereof, a second sealing means transversely filling the tubular member and engulfing a portion of said pair of insulated conductors at a location adjacent the second end of the tubular member spaced from the first sealing means and to prevent fluid communication between space ambient to the tubular member and the interior of the tubular member between such second sealing means and the first sealing means that constitutes a confined space, a plurality of electric lamps longitudinally spaced from each other and disposed in said confined space, and means within said confined space electrically connecting the electric lamps to said pair of insulated conductors to enable electrical energization of the former from the latter.

These and other objects, aspects, features and advantages of the invention will become apparent in the light of the following description of a preferred embodiment of the invention, the same being given in conjunction with the accompanying drawings, wherein:

FIG. 1 is an isometric view of an assembled strip light;

FIG. 2 is an enlarged front elevation of the strip light shown in FIG. 1;

FIG. 3 is a front elevation of the channel component of the mounting means portion of the strip light;

FIG. 4 is an isometric view of the tubular member within which the lamps and their electrical conductors are sealed;

FIG. 5 is an enlarged end view of the channel shown from the plane indicated at 5—5 in FIG. 3, with the position to be occupied therein by the tubular member being shown in dashed outline;

FIG. 6 is an enlarged isometric view of one of the end pieces included in the mounting means;

FIG. 7 is an enlarged fragmentary detail view of an end portion of an assembled strip light with portions of the channel being broken away to expose to view through the tubular member the disposition of the sealing means in the latter and about the conductors at the point of egress of the conductors from within the tubular member;

FIG. 8 is a broken isometric view of assembly of lamps and electrical conductors prior to placement in the tubular member;

FIG. 9 is a fragmentary view of one end of the tubular member with the assembly of FIG. 8 disposed therein with the use of a hot glue gun being applied to inject a sealant into the end of the tubular member to seal the latter closed; and, FIG. 10 shows a stage of fabrication of the assembly shown in FIG. 8 preparatory to longitudinally shifting the parallel conductors relative to each other into closely spaced parallelism.

Referring now to the drawings wherein like numerals designate like parts throughout the various views, the reference numeral 10 designates the fully assembled strip light generally, the same comprising a lamp unit or subassembly designated generally at 12.

The strip light 10 includes mounting means therefor designated generally at 14 which receives the lamp assembly 12 and enables convenient mounting of the light strip 10.

The lamp assembly 12 comprises a elongated tubular member 16 of flexible and somewhat resilient character. The tubular member 16 is preferably a vinyl plastic that is flexible and sufficiently resilient that upon removal of a force causing deformation thereof the same has a marked tendency to return to its original position of repose, albeit somewhat slowly.

The tubular member 16 can be extruded from vinyl material marketed by the B. F. Goodrich Co. under the trademark GEON VINYLS as GEON 8883 and with which the following technical data is given:

| | |
|---|---|
| Specific Gravity (ASTM-D-792) | 1.26 |
| Hardness (Durometer A + 3) (ASTM-D-676) | |
| Instantaneous | 90 |
| 15 Second Delay | 85 |
| 100% Modulus, psi (ASTM-D-412) | 2150 |
| Brittle Temperature, °F. (ASTM-D-746) | −10 |

While whatever basic material is used to make the tubular member 16, the same may be clear and of high light transmitivity character or, if desired, the same can incorporate a dye or coloring matter to constitute of the same a light color filter. The material of the tubular member 16 can incorporate various well known dyes or coloring material so that selected light colors pass readily therethrough while other colors do not. For example, the tubular member 16 can be such that a white light (such as emitted by a hot filament) emitted within the tubular member will appear as viewed from the outside to be red, amber, green, blue, yellow and the like, depending upon the selected dye or coloring material.

While either or both of the external and internal surfaces of the tubular member 16 can be rough to an extent to diffuse light entering and leaving the material of the tubular member 16, it is preferred that the surfaces be sufficiently smooth or of polished appearance to preclude significant diffusion or scattering of light. Along the same vein, it is preferred that the material of the tubular member be free of light scattering or diffusing particles except as may be incidental to the inclusion of color filtering substances. Such, of course, may be included if deemed necessary or expedient without departing from the spirit of the invention.

For a purpose to be presently explained, the tubular member is preferably not circular in transverse cross section, but rather of a "D" or symmetrical trapezoid configuration as may be seen on inspection of FIG. 5. The external dimensions of the tubular member 16 can, by way of example only, be such that the spacing of its parallel sides is 0.277 inch with such sides having widths of 0.165 inch and 0.389 inch. The wall thickness is about 0.040 inch. Such size is well suited for use with size T-1 lamps hereinafter mentioned.

The lamp assembly 12 includes a lamp and electric harness designated generally at 18 that is constituted of a plurality of electric lamps 20 that are connected in electrical parallel between a pair of electric conductors 22 and 24 which can be of copper and size No. 28. The lamps 20 are conventional incandescent lamps in that they include a glass envelope surrounding a filament (not shown) that is energized by a pair of flexible electric leads 26 and 28 extending from the envelope. The lamps 20 are preferably at least as small as lamps known in the art and obtainable from many hobby shops as "wheat" lamps. Still smaller lamps are especially preferred such as size T-1 that draw 30 ma from a 12 volt power source. Such lamps consume only about 0.36 watt and result in only a slight temperature rise in their surroundings. The small amount of heat generated appears to be readily conducted away by the leads and otherwise dissipated even when very little, if any, free ambient air movement can occur. Indeed, it appears that very little temperature rise can be caused by the small lamps even when affirmative steps are taken to minimize the dissipation of heat.

In the assembly 18 as shown in FIG. 8, it will be seen that the flexible conductors 22 and 24 are in closely spaced and in substantial parallelism, with the leads 26 and 28 of the lamps being mechanically and electrically connected respectively to the conductors 24 and 22. Each of such connections preferably involving a lead being twisted about and soldered to its respective conductor, such as, for example, the connection of the lead 26 to the conductor 24 indicated at 30, and the connection of the lamp lead 28 to the conductor 22 indicated at 32. Alternatively, the connections 30 and 32 can simply be spot welded connections.

It will be noted that the leads 26 and 28 of each lamp 20 extend in opposite directions from each other and in approximate parallelism with the conductors 22 and 24. All the leads 26 extend in the same direction, with the length of the connected leads 26 and 28 and the spacing of the lamps 20 being such that the connections 30 and 32 occur alternately and in spaced relation to each other. In other words the overall longitudinal extent of the leads of each lamp is longitudinally spaced from the leads of adjacent lamps. In particular, no lead 26 contacts any other lead 28.

Excepting only the positions of connections 30 and 32 along thin extents, the conductors 22 and 24 are electrically insulated, and such conductors can be enameled copper wire such as known as magnet wire and commonly used in the winding of transformers. For a reason to become evident, the enamel is preferably of the type known as "non-residual, thermo-soluble" for the reason that the same will break down and allow the making of a clean soldered connection to the conductor by the application of soldering temperature thereto.

The leads 26 and 28 of the lamps 20 as well as the connections 30 and 32 can be uninsulated for the reason that the geometry of the assembly 18 is such that the only electrical path between the conductors 22 and 24 is through the lamps 20.

At one end of the assembly 18, the conductors 22 and 24 terminate at positions 36 and 38 that are longitudinally spaced from each other to avoid an electrical path therebetween. At their other ends, the conductors 22 and 24 are mechanically and electrically connected to the conductors of an insulated two-conductor cable 40 with such connections being insulated by short lengths of shrink tubing 42 and 44 disposed thereabout. The two-conductor cable 40 is of greater size and strength than the insulated conductors 22 and 24, for the reason that it is for the purpose of connecting the latter to an external electrical power source as will become clear.

The lamp assembly 18 is disposed within the tubular member 16 with the free ends 36 and 38 of the conductors 22 and 24 being disposed in close proximity to one end 48 of the tubular member 16. Adjacent the other end 50, the rear side 52 of the tubular member 16 is provided with an opening 54. The extent of the lamp and wiring harness 18 is such that the connections of the cable 40 to the conductors 22 and 24 are adjacent the opening 54 so that the two-conductor cable 40 extends from within the tubular member 16 and then to the rear or bottom of the tubular member 16 through the opening 54 as clearly shown in FIGS. 4 and 7. The assembly or harness 18 can be conveniently placed in the tubular member 16 by engaging the end 36 thereof in a slotted end of a thin and elongated insertion rod (not shown) and pushing the assembly 18 endwise into the tubular member 16 through a funnel or tapered hollow guide (not shown) that is partially received in the end 50 of the member 16. After harness 18 insertion, the rod is withdrawn and the funnel removed, after which the cable 40 is pushed through the opening 54.

The end 48 remote from the end 50 of the tubular member 16 is sealingly closed by a body 60 of sealant material filling the tubular member 16 at the end 48 thereof with such body of sealant material extending into the tubular member 16 a short interval that is sufficient in extent so that the ends 36 and 38 of the conductors 22 and 24 are embedded therein and thereby secured against dislodgment. In a similar fashion the other end 50 of the tubular member is sealingly closed by a body 66 of sealing material that extends into the tubular member 16 a short interval that is sufficient to fill the tubular member 16 along its extent that includes the opening 54 with the portion of the cable 40 within the tubular member 16 and in the opening 54 being embedded within the sealing material in a sealing fashion.

As thus far described, the bodies 60 and 66 of sealing material completely seals the hollow interior of the tubular member 16 wherein the lamps 20 and their connections 30 and 32 are excluded from fluid communication with space external to the tubular member 16 through either of its ends 48 and 50 or the opening 54.

In the preferred construction, the sealant material constituting the bodies 60 and 66 is of thermoplastic character such as that commercially available as Formula 4046 sold by the Ornsteen Chemical Company of New Hampshire. Such material softens at temperatures in excess of about 350° F. for purposes of application and on cooling as physical properties sufficiently compatible with the vinyl of the tubular member 16 as not to become ineffective as a seal upon flexure of the tubular member 16. To further enhance the physical compatibility of the sealing material with the vinyl of the tubular member 16, the aforementioned commercial sealing material is preferably modified by the admixture therewith of vinyl so that the added vinyl constitutes from about 5% to about 10% of the resultant mixture by weight. It is thought that such inclusion of vinyl in the sealing material improves the bonding or adherence of the bodies 60 and 66 to the vinyl tubular member 16.

In the preferred manner of effecting the seals by the bodies 60 and 66, a conventional and commercial high pressure hot glue gun of the type indicated at 70 in FIG. 9 is employed. The gun includes provision 72 for connection to a source of pressurized air and is also provided with means 74 for connecting the same to a source of electrical energy whereby thermostatically controlled electric heater elements, not shown, maintain the molten contents (sealing material) within the gun 70 at a preselected temperature. Under the control of the finger operated trigger 78 of the gun 70, molten sealant material is discharged from the gun tip 80 into the open end 48 of the tubular member 16, with this step being performed with the end 48 of the tubular member 16 being inclined upwardly as shown in FIG. 9. The trigger 78 is released and the discharge of sealant material discontinued as soon as the sealant material flows sufficiently far to engulf the adjacent end of the harness 18. Needless to say, such flow is discontinued before the sealant material reaches the nearest lamp. Preferably, the sealant material is introduced into the tubular member 16 at a temperature of about 400° to about 450° F. Such temperature most desirably is about 100 or more degrees F. above the temperature at which the vinyl of the tubular member 16 starts to soften, it being thought that such elevated temperature contributes to the tenacity of the bond or adhesion of the sealing material to the tubular member 16. It should be noted that under room temperature conditions, the sealant material cools sufficiently rapidly that no actual flow of the material of the tubular member 16 actually occurs. This is also possibly due in part to the thermal inertia of the tubular member 16 which is at room temperature prior to the introduction of the sealant material. Obviously, any apparent softening of the tubular member 16 indicates a necessity for reduction in the temperature of the sealant material.

Shortly after terminating the introduction of sealant material, the introduced sealant material cools sufficiently under room conditions to stiffen and set up as the body 60.

The formation of the body 66 is effected in substantially the same manner as that of the body 60 with one important exception now to be explained. Inasmuch as the end 52 of the tubular member 16 is closed by the body 66, the introduction of molten sealing material into the end 50 of the tubular member 16 tends to be opposed or impeded by reason of thermoexpansion of air trapped in the tubular member 16. The exception mentioned above has to do with counteracting the effects of the thermally expanding trapped air, and such entails radially collapsing an intermediate portion of the extent of the tubular member 16 by applying an external force thereto so as to reduce the internal volume of the tubular member prior to commencing the introduction of the sealing material into the open end 50 of the tubular member 16. The commencement of the introduction of molten sealing material tends to remain stationary in the tubular member 16 rather than being expelled therefrom. The objective is to collapse the tubular member 16 sufficiently to discharge a volume of air therefrom approximately equal to or somewhat in excess of the amount of thermoexpansion that will occur on introducing the molten sealing material.

In a manner analogous to the introduction of the body 60, the introduction of molten material into the end 50 is discontinued as soon as the molten material flows inwardly past the opening 54 and engulfs the cable 40. Under normal room temperature conditions, the molten sealant material soon cools to form the body 66.

The mounting means 14 comprises an elongated channel 84 having converging sides 86 and 88 joined by a flat web 90. The inner width of the web 90 is approximately that of the bottom or rear wall 52 of the tubular member 16. The channel 84 is provided with a pair of identical end pieces 92 and 94. As best shown in FIG. 6, the end piece 94 comprises a body having a flange 96 projecting from one end thereof that is slidingly receivable within one end 98 of the channel 84 when seated against the web 90. The opposite sides of the end piece 94 include portions 98 that slidingly engage the adjacent surfaces of the channel sides 86 and 88, with shoulders 100 seating against the end 98 and limiting the insertion of the end piece 94 into the channel 84. The end piece 94 is also formed with an abutment 102 that extends upwardly from the flange 96 and extends between and above the adjacent free edges of the channel sides 86 and 88.

The length of the channel 84 is such that when the end pieces 92 and 94 are received in its opposite ends, the spacing or distance between the adjacent and opposed faces of the abutments 102 is only slightly in excess of the overall length of the tubular member 16 or lamp assembly 12. The flanges 96 of of the end pieces 92 and 94 are provided with apertures 110 that are in alignment with openings 112 provided in the channel web 90. The web 90 is also provided with another opening 114 that corresponds to the position of emergence of the cable 40 from the tubular member 16.

The assembly and the mounting of the strip lamp 10 will now be readily understood. The end pieces 92 and 94 are inserted in the opposite ends of the channel 84, and the same is then attached to structure where it is desired the strip light 10 be positioned. Assuming a wall, not shown, to be such structure, screws such as the screw 114 shown in FIG. 7 are passed through the apertures 110 and the aligned openings 112 and screwed into such wall. Either prior to or after attaching channel 84 to such wall as stated above, an opening is made through such wall in alignment with the opening 114. After the channel 84 has been attached to the wall and there has been provided an opening in the wall in alignment with the opening 114, the cable 40 is fed through the opening 114 and the aligned opening in the wall, after which the end 50 of the tubular member 16 is placed against the abutment 102 of the end piece 94 and the end portion of the tubular member 16 adjacent the end 50 thereof is forced between the channel sides 86 and 88 toward the web 90, with the side 48 of the tubular member 16 facing the web 90. The converging sides 86 and 88 of the channel 84 define a restricted entrance 120 to the interior of the latter that is of a lesser dimension than the width of the side 48 of the tubular member 16, and accordingly, the use of a screwdriver blade or the like is necessary in order to force the end portion of the tubular member 16 adjacent the end 50 through such restricted entrance 120. After such end of the tubular member 16 has been forced into the channel 84 while avoiding slack in the cable 40 within the channel 84, the screwdriver or the like is applied to force the entire extent of the tubular member into the channel 84 proceeding progressively along the extent of the tubular member 16 toward the end 48 thereof.

The "D" shape of the transverse configuration of the tubular member 16 conforms substantially to the internal configuration of the channel 84 as clearly shown in FIG. 5, with the bight or side 126 of the tubular member 16 projecting well above or outwardly from the restricted entrance to the channel 84 defined by its converging sides 86 and 88. The arrangement is such as to expose the lamps 20 to view from a wide angle.

The elasticity or resilience of the tubular member 16 enables the deformation necessary to push the same into the channel 84 and thereafter to resume its position of repose thereof shown in dashed outline in FIG. 5 to preclude dislodgment from within the channel 84.

With the strip light mounted and assembled as described, the conductors of the cable 40 are connected in a conventional manner to any suitable source of electrical energization, not shown.

In the preferred construction, the channel 84 is made of sufficiently ductile metallic material that the same can be bent intermediate its ends about a radius for 90° so as to be mountable about a rounded corner of an external wall, the flexibility of the lamp assembly 12 enables mounting thereof in such bent channel.

Attention is now directed to an expeditious procedure or method for connecting the lamps 20 to the conductors 22 and 24 such that the application of heat to effect soldering at one position limits the effects of temperature to the immediate vicinity of such position so as to not damage insulation remote from the solder joint. Also such method allows easier access to the connections 30 and 32 at the time such connections are made.

The efficacious procedure or method for making the mechanical and electrical connections 30 and 32 will be best appreciated on reference to FIG. 10. The method involves placing the magnet wires 22 and 24 in substantially spaced parallel condition. A lamp 20 is centrally placed between the spaced wires 22 and 24 with its oppositely extending leads 26 and 28 substantially coplanar with and substantially perpendicular to the wires 22 and 24. An end portion of the lead 26 is tightly twisted or coiled about the wire 24, and by means not shown heat and solder are applied to such end portion of the lead 26 and that part of the wire 24 about which it is twisted. The temperature of the applied heat is such as to break down the enamel insulation of the wire 24 at the point of heat application so that a sound mechanical and electrical connection is established on cessation of the application of heat. The connection 30 is thus made with virtually no damage to the enamel insulation of the wire 24 outside the immediate proximity of the connection 30. It is to be especially noted that the wire 22 is substantially spaced from the wire 24 at the time the connection 30 is effected so as to avoid any possibility of heat damage to the wire 22 while at the same time access to the connection 30 is optimized by the above described geometry.

The connection 32 is made in an analogous manner to that described in the making of the connection 30, excepting of course the connection 32 involves connecting the lead 28 to the magnet wire 22. It will be evident to those skilled in the art that the connections 30 and 32 for a lamp 20 can be made simultaneously or in timed sequence. A plurality of lamps 20 are sequentially connected to the magnet wires 22 and 24 in the described manner, it being important to note that the spacing of the lamps 20 from each other is greater than the spacing of the connections 30 and 32 of each lamp. After a substantial number of lamps 20 have been connected to magnet wires 22 and 24 (perhaps enough to make a plurality of strip lights 10), the magnet wire 24 can be longitudinally shifted to the left relative to the magnet wire 22 to obtain the lamp and furnace configuration indicated at 18 in FIG. 8. Appropriate lengths of the resulting product can then be severed from one another and terminated as at 36 and 38 and connected to cables 40 to complete assemblies 18 as will be readily understood.

If deemed desirable or expedient, the connections 30 and 32 can be simply welded connections so that the twisting of the lamp leads and the use of solder may be obviated. The special magnet wire enamel mentioned previously lends itself well to the connections 30 and 32 being of welded character.

Attention is now directed to the appended claims for an appreciation of the actual scope of the invention.

I claim:

1. For use in a strip light, a pair of insulated electrical conductors in closely spaced side by side relationship, a plurality of electric lamps spaced along said pair of conductors, each of said lamps having a pair of oppositely extending electric leads disposed in side by side relationship with said pair of insulated conductors and having first and second remote extremities respectively connected electrically and mechanically to one and the other of said pair of insulated conductors, said lamps having a spacing along the pair of insulated conductors sufficiently great that the electric leads of each lamp is spaced along such electric conductors from the electric leads of the lamps adjacent thereto, the arrangement being such that the lamps are connected in electrical parallel between the conductors and such that the electric leads need not be electrically insulated to avoid any electrical shorting path between the conductors, an elongated tubular member having a light transmitting characteristic, said insulated conductors and all of said lamps being disposed within and extending along the length of the hollow interior of the tubular member with said insulated conductors having an end portion that extends outwardly from the tubular member at a position of egress therefrom, and sealing means within the tubular member and adjacent the ends of the latter for preventing fluid communication between the exterior of the tubular member and the lamps within the tubular member, said tubular member having a lateral opening adjacent one end thereof at said position of egress, with said end portion of the insulated conductors extending through said lateral opening, and with said sealing means also sealing said lateral opening against fluid communication therethrough.

2. The combination of claim 1, together with mounting means comprising an elongated channel member including a pair of side flanges connected by a web, said flanges being convergent outwardly from the web, said tubular member being disposed in the channel member and retained therein by the convergent flanges, and said web having an opening therethrough through which the end portion of the insulated conductors extend.

3. The combination of claim 2, including a pair of end pieces positioned within opposite end portions of the channel member and abutting opposite ends of the tubular member to prevent endwise movement of the latter, each of said end pieces including an integral projecting tab disposed intermediate the tubular member and the web of the channel member, and said web and said tabs being provided with aligned openings therethrough.

4. The combination of claim 3, wherein the end pieces are slidingly received within the opposite end portions of the channel member, and wherein said end pieces are provided with shoulders limiting the extent of their reception into the channel member to facilitate alignment of the openings through the tabs and the web and to facilitate realization of a predetermined spacing of the end pieces, whereby the end pieces can be positioned in the channel member with the aligned openings being adapted to accommodate mounting screws therethrough, and whereby the tubular member can thereupon be pushed into the channel member between the flanges thereof after the end portion of the insulated conductors have been passed through the first mentioned opening in the web.

5. The combination of claim 2, wherein said tubular member is of a generally trapexoidal transverse configuration and has a relatively wide side connected by converging sides to a relatively narrow side, with the relatively wide side of the tubular member being within the channel member and facing the web thereof.

6. The combination of claim 5, wherein said relatively narrow side of the tubular member is disposed outwardly of the channel member.

7. In light strip construction, an elongated tubular member having first and second ends, and being provided with a pair of insulated and flexible electric conductors extending from a position within the interior of the tubular member to the exterior thereof, a first sealing means transversely filling the tubular member at a location adjacent the first end thereof, a second sealing means transversely filling the tubular member and engulfing a portion of said pair of insulated conductors at a location adjacent the second end of the tubular member spaced from the first sealing means and to prevent fluid communication between space ambient to the tubular member and the interior of the tubular member between such second sealing means and the first sealing means so that a confined space is defined within the tubular member, a plurality of electric lamps longitudinally spaced from each other and disposed in said confined space, means within said confined space electrically connecting the electric lamps to said pair of insulated conductors to enable electrical energization of the former from the latter, and said tubular member having a lateral opening adjacent said second end, with the pair of conductors extending from within the tubular member to space ambient to the latter through the second sealing means and such lateral opening.

8. In light strip construction, an elongated tubular member having first and second ends, and being provided with a pair of insulated and flexible electric conductors extending from a position within the interior of the tubular member to the exterior thereof, a first sealing means transversely filling the tubular member at a location adjacent the first end thereof, a second sealing means transversely filling the tubular member and engulfing a portion of said pair of insulated conductors at a location adjacent the second end of the tubular member spaced from the first sealing means and to prevent fluid communication between space ambient to the tubular member and the interior of the tubular member between such second sealing means and the first sealing means so that confined space is defined within the tubular member, a plurality of electric lamps longitudinally spaced from each other and disposed in said confined space, means within said confined space electrically connecting the electric lamps to said pair of insulated conductors to enable electrical energization of the former from the latter, with said tubular member being a flexible synthetic resin possessing at least sufficient elasticity to substantially reassume its original transverse configuration following removal of transverse compressive force causing deformation thereof.

9. The combination of claim 8, wherein said synthetic resin is a poly-vinyl chloride.

10. The combination of claim 9, wherein each of said sealing means is of a heat fusible and elastomeric type, with each of said sealing means including at least 5% a poly-vinyl chloride by weight, whereby the adherance of the sealing means to the tubular member is enhanced.

11. The combination of claim 7, together with mounting means comprising an elongated channel member inclusive of a pair of side flanges connected by a web, with the flanges being inclined toward each other outwardly from the web and having a spacing at their outermost extremities less than the width of the web, said tubular member being disposed in the channel and having a transverse dimension greater than the last mentioned spacing.

12. The combination of claim 11, wherein the web has an opening therethrough in registry with said lateral opening with a pair of insulated conductors extending through the opening in the web.

13. The combination of claim 2, wherein said tubular member is a synthetic resin having sufficient elasticity and resiliency to be forceable laterally into the channel member between the flanges and thereafter resiliently expand to engage the flanges, whereby the mounting means may remain installed and be provided with a replacement for the tubular member and its contents that may have become defective.

14. The combination of claim 13, wherein the tubular member is deformable and of a generally trapezoidal transverse section with opposite convergent sides that engage adjacent sides of the convergent flanges.

* * * * *